US009849938B2

(12) United States Patent
Van der Kam et al.

(10) Patent No.: US 9,849,938 B2
(45) Date of Patent: Dec. 26, 2017

(54) THRUSTER ASSEMBLY IN A MARINE VESSEL

(71) Applicant: WARTSILA NETHERLANDS B.V., Drunen (NL)

(72) Inventors: Aad Van der Kam, Drunen (NL); Bart Van der Ven, Drunen (NL)

(73) Assignee: WARTSILA NETHERLANDS B.V., Drunen (NL)

( * ) Notice: Subject to any disclaimer, the term of this patent is extended or adjusted under 35 U.S.C. 154(b) by 167 days.

(21) Appl. No.: 14/433,297

(22) PCT Filed: Oct. 16, 2012

(86) PCT No.: PCT/FI2012/050993

§ 371 (c)(1),
(2) Date: Apr. 2, 2015

(87) PCT Pub. No.: WO2014/060636

PCT Pub. Date: Apr. 24, 2014

(65) Prior Publication Data

US 2015/0259038 A1 Sep. 17, 2015

(51) Int. Cl.
*B63B 1/38* (2006.01)
*B63B 17/00* (2006.01)
(Continued)

(52) U.S. Cl.
CPC ..... *B63B 17/0018* (2013.01); *B63B 1/38* (2013.01); *B63H 5/125* (2013.01); *B63H 21/36* (2013.01); *B63B 59/04* (2013.01); *B63B 2001/387* (2013.01); *B63H 2001/286* (2013.01); *B63H 2005/1256* (2013.01); *Y10T 137/6906* (2015.04)

(58) Field of Classification Search
CPC . B63B 17/0018; B63B 2001/387; B63B 1/38; B63H 1/38
See application file for complete search history.

(56) References Cited

U.S. PATENT DOCUMENTS 5,575,232 A * 11/1996 Kato ..... B63B 1/38 114/67 A
6,361,386 B1 * 3/2002 Savikurki ..... B63B 17/0018 440/112

(Continued)

FOREIGN PATENT DOCUMENTS

WO 2010/136012 A1 12/2010
WO 2011/127987 A1 10/2011

OTHER PUBLICATIONS

International Search Report for PCT/FI2012/050993, dated Apr. 5, 2013.

*Primary Examiner* — Kevin Murphy
(74) *Attorney, Agent, or Firm* — Heslin Rothenberg Farley & Mesiti P.C.; Victor A. Cardona, Esq.

(57) ABSTRACT

An assembly in a marine vessel includes a unit arranged in a water tight chamber opening in a hull of a vessel, wherein the unit is adapted to extend into the water below the vessel when at a mounted position. A connection path between an inside and an outside of the vessel is provided with a sealing system and the sealing system divides the connection path into an outside connection path portion and an inside connection path portion. The assembly includes a gas inlet system opening to the outside connection path portion.

10 Claims, 8 Drawing Sheets

(51) Int. Cl.

| | |
|---|---|
| ***B63H 5/125*** | (2006.01) |
| ***B63H 21/36*** | (2006.01) |
| *B63H 1/28* | (2006.01) |
| *B63B 59/04* | (2006.01) |

(56) References Cited

U.S. PATENT DOCUMENTS

| | | | | |
|---|---|---|---|---|
| 6,823,812 | B2 * | 11/2004 | von Wolske | B63B 39/061 114/286 |
| 7,992,275 | B1 | 8/2011 | Bekker et al. | |
| 2011/0168078 | A1 * | 7/2011 | Takano | B63B 1/38 114/67 A |

* cited by examiner

THRUSTER ASSEMBLY IN A MARINE VESSEL

CROSS REFERENCE TO RELATED APPLICATIONS

This application is a national stage filing under section 371 of International Application No. PCT/FI2012/050993, filed on Oct. 16, 2012, and published in English on Apr. 24, 2014, as WO 2014/060636 A1, the entire disclosure of this application being hereby incorporated herein by reference.

TECHNICAL FIELD

The invention relates to an assembly in a marine vessel comprising a unit arranged in a water tight chamber opening in a hull of a vessel, wherein the unit is adapted to extend into the water below the vessel when at its mounted position, which assembly comprises a connection path between in inside and outside of the vessel.

BACKGROUND ART

Document WO 97/27102 describes a method and apparatus for removing a propeller assembly from an opening of a floating vessel, wherein the propeller assembly is designed to close an opening in the vessel hull when the propeller assembly is in its mounted position. According to this prior art, a watertight hoisting chamber is provided around the propeller assembly and inside that hoisting chamber a drive shaft is provided, which leads to a drive motor positioned in the vessel and outside of the hoisting chamber. When the known propeller assembly is to be removed, the drive shaft is removed first. Then its passage through the hoisting chamber wall is closed in a watertight manner. After that the propeller assembly is connected to hoisting means and then a flange of the propeller assembly is loosened. Then, the propeller assembly can be lifted from the hoisting chamber. The propeller assembly is also known as thruster. The method according to the prior art requires assembly/disassembly work which has to be carried out under water.

Further, large vessels can have a draught which is up to 20 meters under water surface level. In this case, considerable forces act to push the thruster upwards and inside the vessel due to the difference in pressures between the water pressure outside and the air pressure inside the vessel. With large thrusters, the forces pushing up the thrusters which are not compensated by thruster weight may reach up to 2000 kN. When the fixing screws of the flange are removed, the propeller assembly or thruster is lifted by these forces in uncontrolled manner. Having such a heavy mass which moves in uncontrolled manner is dangerous. Further, loosening of the fixing of the flange while under these forces is difficult.

Document WO 20111279878 A1 describes a method of maintenance of a unit arranged in the watertight hoisting chamber and closing an opening in a vessel hull, wherein the unit is adapted to extend into the water below the floating vessel. The method comprises the steps of clamping the unit in its mounted position by clamping means, releasing fixing means which fix the unit into its mounted position while holding the unit clamped in its position and at least partly flooding the hoisting chamber, then releasing the clamping of the unit and hoisting the unit away from its mounted position. A clamping means is used to clamp the unit in its mounted position before the fixing means, which are normally used for mounting the unit into its position, are removed. In this way, the opening can be held closed and the unit is held in position, so that the work for releasing the fixing means can be carried out while it is still dry in the hoisting chamber. After the fixings are removed, the hoisting chamber is at least partly flooded either by provision of an extra valve for flooding the chamber or by a controlled release of the clamping of the unit. When the clamping is released, the water in the at least partly flooded hoisting chamber puts some pressure on the unit from the vessel inside, so that the pressure differences at the unit between inside and outside the vessel are reduced. Therefore, the forces pushing up the unit can be reduced. Even if the method is beneficial as such there has emerge some need to further develop the method.

In view of the above prior art, it is the object of the invention to provide an assembly in a marine vessel which provided improved closing operation of a unit arranged in a water tight chamber opening in a hull of a vessel.

DISCLOSURE OF THE INVENTION

Object of the invention are met with an assembly an assembly in a marine vessel comprising a unit arranged in a water tight chamber opening in a hull of a vessel, wherein the unit is adapted to extend into the water below the vessel when at its mounted position, which assembly comprises a connection path between in inside and outside of the vessel which connection path is provided with a sealing system and which sealing system divides the connection path to outside connection path portion and inside connection path portion, In is characteristic to the invention that the assembly comprises a gas inlet system opening to the outside connection path portion.

According to an embodiment of the invention the gas inlet system comprises a conduit extending through the unit.

According to an embodiment of the invention the gas inlet comprises a conduit extending through the vessel hull.

According to an embodiment of the invention the conduit is in connection with a source of inert gas.

According to an embodiment of the invention the source of inert gas comprises an air-nitrogen converter.

According to an embodiment of the invention the conduit is in connection with a source of pressurized air.

According to an embodiment of the invention the sealing system is arranged to a periphery surface of the flange.

According to an embodiment of the invention the sealing system is arranged to a lower surface of the flange plate portion.

According to an embodiment of the invention the assembly comprises a control system for maintaining a predetermined supply of gas to the inlet gas system.

According to an embodiment of the invention the control system comprises a valve.

According to an embodiment of the invention the control system comprises an orifice plate.

BRIEF DESCRIPTION OF DRAWINGS

In the following, the invention will be described with reference to the accompanying exemplary, schematic drawings, in which.

DETAILED DESCRIPTION OF DRAWINGS

Figure 1:
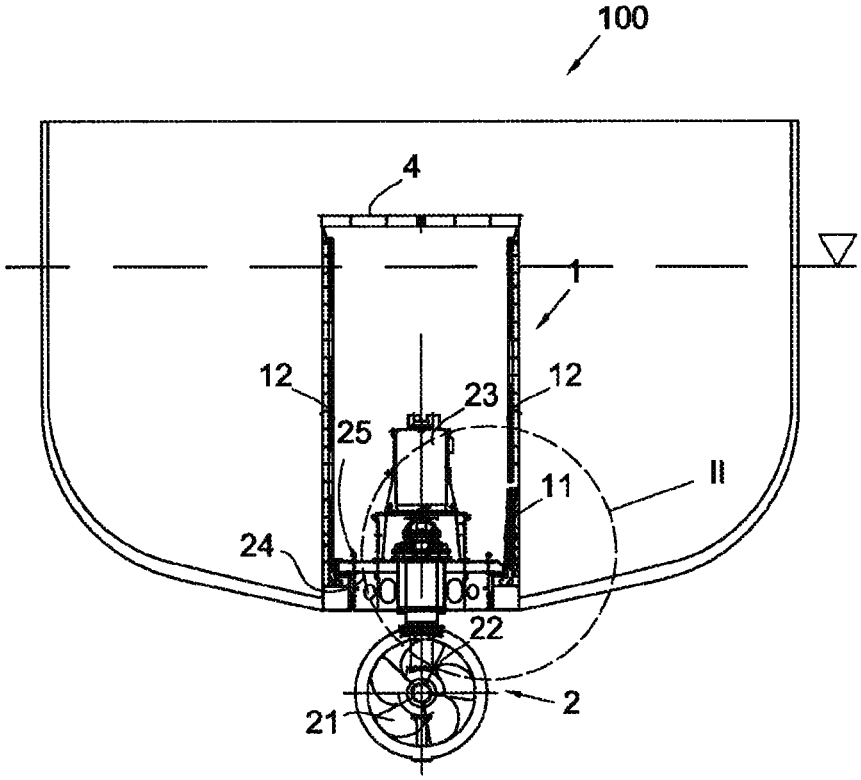
FIG. 1 shows a section of a vessel with a hoisting chamber and a mounted unit.

FIG. 1 shows a vessel hull 100 which floats in water as is indicated with the broken line in FIG. 1. Inside the vessel, there is provided a hoisting chamber 1 which is a fixed construction mounted to the vessel 100. Inside the hoisting chamber 1 there is a unit 2 which extends through the vessel hull 100 to the outside. This is the unit which requires maintenance. Here, the unit is a so-called thruster 2. The thruster 2 has a propeller 21, a gear housing 22, a flange 24 and an electric motor 23 for driving the propeller 21. Another term often used in practice for the flange 24 is mounting can; hereinafter the term flange is used for that part. Of the thruster 2, the propeller 21 and the gear housing 22 are the elements immersed in water, while the flange 24 closes the opening in the vessel hull 100 when the unit is mounted to the vessel. The propeller 21 and the gear housing 22 may be rotated around an axis substantially perpendicular to the rotational axis of the propeller 21. This kind of thruster is often used in connection with large vessels for position control and for maneuver assistance. The flange 24 may also be developed and contain a gear box and drive means for rotating the thruster around its substantially vertical axis.

FIG. 1 further shows that hoisting chamber 1 has guide rails 12 at its wall extending along the chamber in its height direction; here two guide rails 12 are shown. Also, clamping means 11 are shown which will be discussed in more detail under reference being made to other drawing figures. It is noted that only a pair of clamping means 11 is shown in FIG. 1 although typically up to eight clamping means are provided which are arranged on a circle at equal angular intervals around the flange 24.

Further, FIG. 1 shows a cover 4 of the hoisting chamber, which preferably water tightly closes the hoisting chamber at its upper end. One of the functions of this cover is of course to avoid that someone may fall into this chamber (in the shown example vessel's draught i.e. the depth of the chamber is about 18 meters) and, on the other hand, the cover is additional protection against immersion of water into the vessel if the opening in the vessel bottom is not tightly closed for whatever reason.

Figure 2:
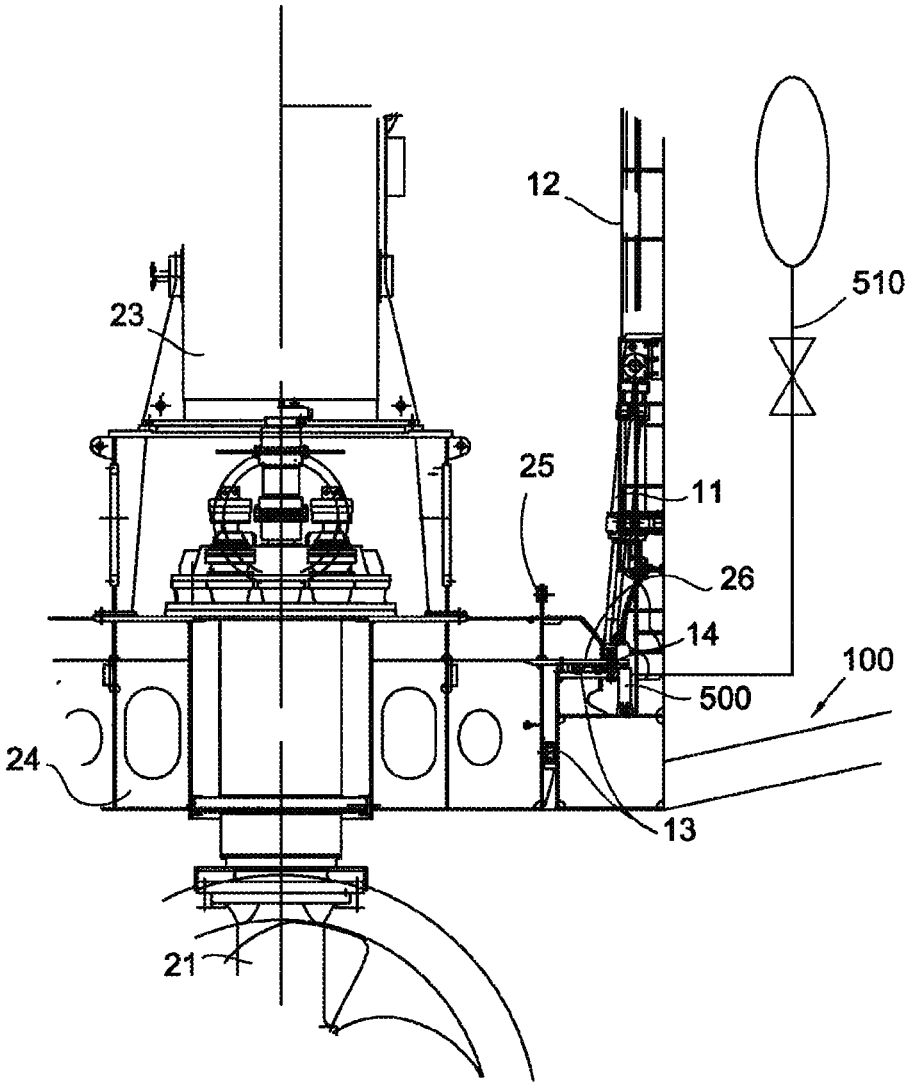
FIG. 2 shows an enlarged schematic view of a portion of FIG. 1 where a part of the hoisting chamber and a part of the unit is shown.

FIG. 2 shows an enlarged view of a section II of the arrangement of the thruster 2 at a portion close to the flange 24 of the thruster. The flange 24 of the thruster further comprises hoisting eyes 25 and a flange plate portion 26, which cooperates with seals 13 for water tightly closing the opening in the vessel hull 100. Screws 14 form the fixing means and a number of screws are provided along the flange plate portion 26 in a rim around the unit 2. FIG. 2 shows a part of the hoisting chamber wall, which hoisting chamber wall carries two guide rails. It should be understood that the flange and the bottom opening in the hoisting chamber may be formed suitably according to the need. They may have for example circular, rectangular or polygon form, or a combination thereof.

Although not shown, unit 2, in particular the flange 24 thereof, has guide means which cooperate with the guide rails, when the unit is moved inside the hoisting chamber. Although two guide rails 12 are shown in FIG. 1, any suitable number of guide rails can be provided. Also, clamping means 11 are shown fixed to the hoisting chamber wall. Functional cooperation of the clamping means 11 with the flange 24 of the unit 2 will be described by reference being made to FIG. 3.

Further, FIG. 2 shows an electric motor 23 which is fixed to a gear box having a coupling so as to be in drive connection with a propeller 21 of the unit 2. Of course, other types of motors may be used as well.

Figure 3:
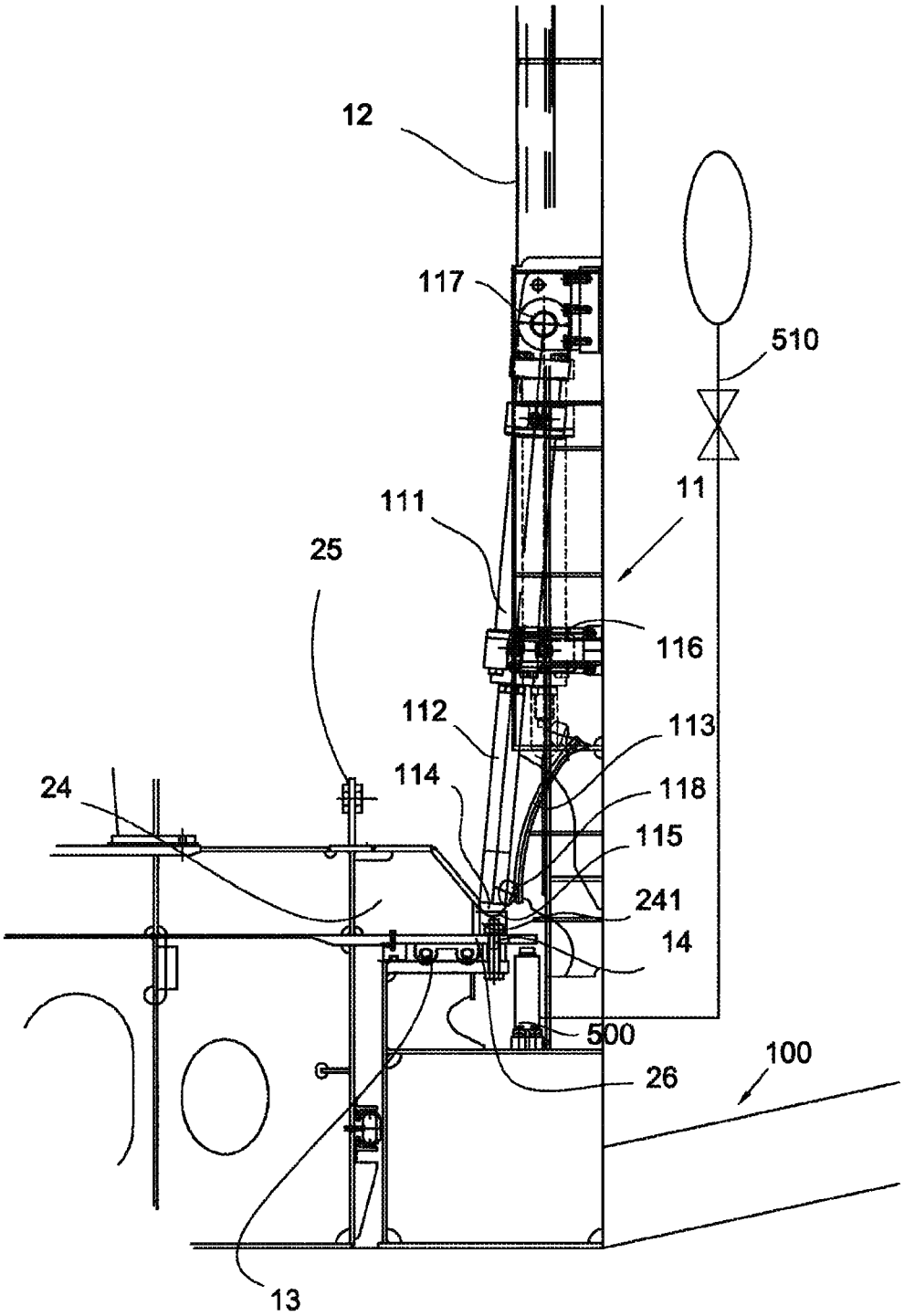
FIG. 3 shows a detail of a clamping means cooperating with the unit.

Turning now to FIG. 3, a detail of a clamping means 11 as shown of the right-hand side of FIG. 2 is shown in more detail in FIG. 3. The clamping means 11 has a hydraulic cylinder 111 which has a cylinder rod 112. By controlling flow of hydraulic fluid to and from the cylinder 111, movement of the rod 112 can be controlled. At the end of the rod 112 there is shown a clamp 114, which is adapted to cooperate with a clamping pad 115 provided on the flange 24 of the unit 2. Also, FIG. 3 shows the fixing screws 14 serving as the fixing means and a seal 13 for water tightly sealing the connection between the unit 2 and the vessel hull 100. It is noted that the clamping pad 115 here has the form of a shallow recess cut into the plate-shaped member 241 which is fixed to the flange 24 and the flange plate portion 26.

Furthermore, FIG. 3 shows a guide surface 113 which is inclined outwardly with increasing height of the hoisting chamber. The guide surface 113 cooperates with the clamp 114 of the clamping means 11. With the cylinder bolt 117 the hydraulic cylinder 111 is fixed to the hoisting chamber wall, so that the cylinder 111 can pivot around this cylinder bolt 117. Further, an urging means 116 is provided, which urges the cylinder 111 of the clamping means 11 towards the outside of the hoisting chamber so as to ensure that the clamp 114 is always guided by the guide surface 113.

Now starting out from the position of the cylinder 111 shown in dotted lines in FIG. 3, in which the cylinder 111 extends almost parallel to the hoisting chamber wall and the rod 112 is retracted into the cylinder, functions of the clamping means are described. When the flange 24 is to be clamped for holding it (and the unit 2) in its mounted position, the hydraulic cylinder 112 is controlled so as to extend the rod 112. The clamp 114 moves guided by the guide surface 113 towards the clamping pad 115, which guided movement is supported by a guide shoe 118 provided close to the clamp 114 and cooperating with the guide surface 113. Once the cylinder 111 has fully extended its rod 112, the clamp 114 sits into the shallow recess 115 as the clamping pad provided on the flange 24, i.e. on the plate-shaped member 241 thereof. The hydraulic cylinders 111 are strong enough to securely clamp the unit into its mounted position, so that the position of the unit in regard to the opening in the vessel hull can be securely held or maintained while the fixing means 14 are screwed off. In order to securely avoid that any unintentional release of the clamping of the flange 24 may happen, it is suggested that the cylinders 111 are provided with locking valves which cut off the fluid connection of the hydraulic cylinder to the hydraulic system in order to maintain the cylinder in its actual position.

Once the fixing means 14 have been removed and the hoisting means (such as hoisting lines, not shown) is fixed to the lifting eyes 25, the clamping may be gradually released. In particular, looking at FIG. 3, the cylinder 111 is controlled so as to slowly retract the rod 112. Because the fixing means 14 have been removed, and due to the differential pressure between inside the hoisting chamber 1 and the water pressure at the bottom of the vessel 100, the flange 24 will move upward following the cylinder rods 112 movement while keeping the engagement between the shallow recess 115 and the clamp 114. Once the seal 13 lifts up from its counter surface, water may rapidly flow into the hoisting chamber 1. After the hoisting chamber is flooded to a required level, the cylinder 111 may be controlled to further retract the rod 112.

When the pressure differences and forces have been leveled out, the unit 2 following its own weight will again sit on the seal 13 with its flange plate portion 26.

According to an embodiment of the invention the unit further comprises a number of lifting devices 500 arranged in co-operation with the flange 24 and the hoisting chamber 1 in order to apply controllably force to the flange in the upward direction of the hoisting chamber. Such a lifting device is shown the FIGS. 2, 3, 5 and 6. The lifting devices 500 comprise a number of lifting jacks, particularly hydraulic jacks, arranged under the flange plate portion 26 around the unit 2. The lifting devices are preferably arranged substantially symmetrically in respect of center of load to be lifted. The lifting devices 500 are arranged to fit between an extension of the flange plate portion 26 and a lifting base arranged to the hoisting chamber in a retracted position while the flange 24 sits on the seal 13 with its flange plate portion 26. The flange plate portion 26 is provided with a local extension only at the location of the jack 500 against which the jack is supported during the lifting so that the flange portion may pass the guide surface 113.

Each lifting device is provided with or is in connection with a force control system 510, which facilitates controlling of alignment of the flange while installed or removed. The lifting devices may be used during assembly/disassembly of the unit, whether it is a thruster or a closing cover or other kind of unit.

Next in the procedure the hydraulic jacks 500 are activated and the flange 24 is lifted from the seat controllably by the hydraulic jacks. The flange is lifted so that the cylinders 111 and their rods 112 adjustably control the lifting of the flange and the flange 24 will move upward following the cylinder rods 112 and hydraulic jacks 500 movement while keeping the engagement between the shallow recess 115 and the clamp 114. This way the removal of the flange is performed controllably and movement may be kept translational i.e. moving the flange aligned with the opening in the hosting chamber. A low tension on the hoisting lines may also be is applied.

According to an embodiment of the invention the unit is lifted at a first level, the hydraulic cylinders 111 are fully retracted in to their end position. Advantageously the lift is about 150 mm. Once the cylinders have been retracted, following the urging force of the urging means 116, each cylinder 111 will again lie flat or substantially flat against the hoisting chamber wall. The unit 2 may then be lifted to be taken out of the hoisting chamber. A bottom closing cover 6 (shown FIG. 4 *c*)) may be installed to the hoisting chamber to seal the opening. Also a safety hatch may be installed on top of chamber and the chamber may be emptied i.e. water pumped away.

Figure 6:
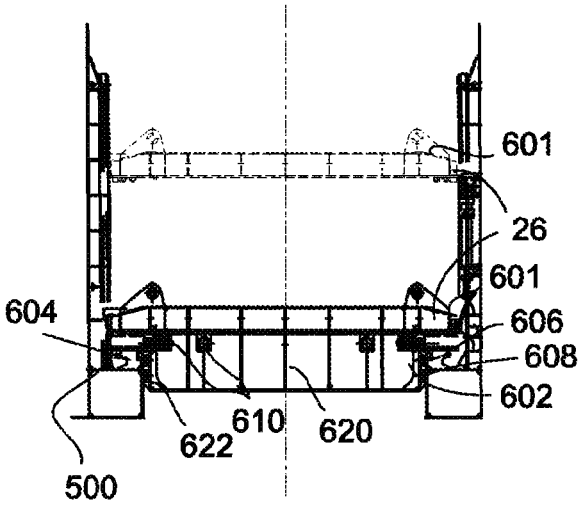
FIG. 6 shows an embodiment of the flange.

As depicted in FIG. 6 according to an embodiment of the invention, the closing cover 6 is arranged of at least two parts, a first part 601 and a second part 602. The parts are here called as top part and lower part, because the first part forms a top (inner) portion of the closing cover and the lower part form the lower (outer) portion of the cover. The lower part has a form such that it can be fitted into the opening in the bottom of the hoisting chamber through the hull. The form may be circular or a polygonal. It is, however, important that particularly the sealing system may properly function at possible corner areas, which are therefore advantageously suitably rounded. The upper part has a flange plate portion 26 by means of which it may be attached to the chamber. In the FIG. 6 the cover 6 is in a position supported by the jacks 500 just before mounting. There is also shown how the upper part 601 may at a removed position by dotted line. The second part 602 comprises a periphery wall 622 and a water tight inner section 620 bordered by the periphery wall. The first part comprising a flange 24 is extending over the periphery wall of the second part, to be outside the area of the lower part 602. The first part and the second part are removably attached to each other. Advantageously the periphery wall outer surface of the second part 602 and the flange plate portion lower surface of the first part are perpendicular to each other. The upper part extends wider than the lower part. The first and the second part are provided with counter surfaces which are joined together when the first and the second part are attached with each other. The surfaces are preferably provided with planar counter surfaces.

Figure 7:
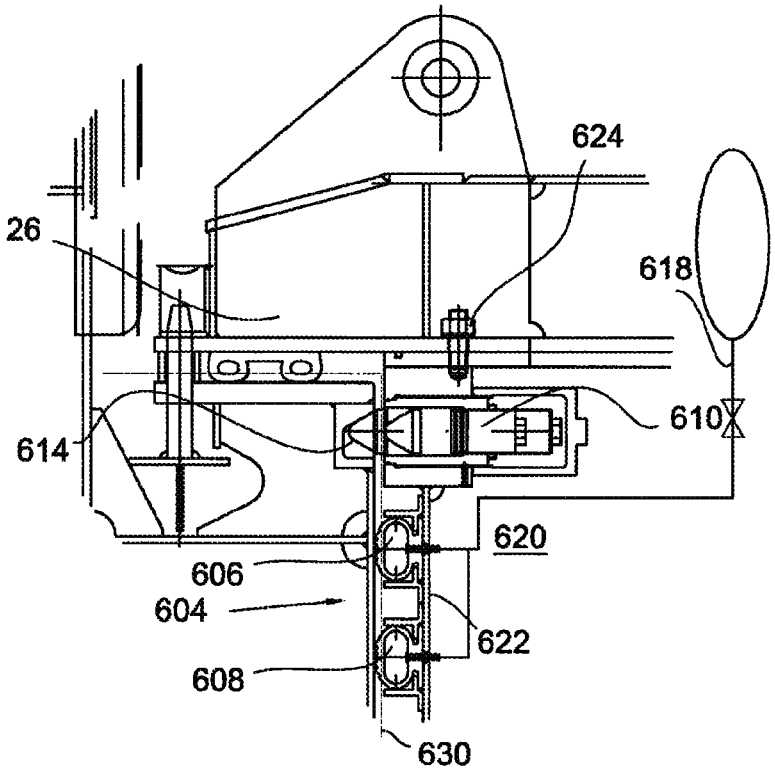
FIG. 7 shows a further embodiment of the flange.

In FIG. 7 there is shown a closing cover according to an embodiment of the invention. The lower part is provided with a sealing system 604 at its outer periphery wall surface 622. The sealing system is controllable so that it may be in active state or in passive state. When it is in active state it seals the gap between lower part and the wall of the hoisting chamber. Preferably there are arranged at least two successive sealing units 606, 608 in the longitudinal direction of the hoisting chamber. The seal units may be inflatable seals so that they may be pressurized by a working fluid when activated and depressurized when deactivated. The seals are provided with or are in connectable with a controllable working fluid supply system 618, such as pressurized air/pneumatic system. The sealing system 604 is arranged in a connection path 630 from outside of the vessel to inside of the vessel along interconnecting surfaces of the closing cover and the hull of the vessel.

The lower part 602 is also provided with attaching means to attach the second part 602 to the vessel hull at least when the upper part 601 is removed. The attaching means comprises a number of holding means 610. The holding means are in this embodiment pins, which may move partially from outer periphery wall surface 622 of the lower part and co-operate with the hoisting chamber, in which a mating recess 614 has been arranged thus, when activated or pushed out, locking the lower part 602 to its locking position in the hoisting chamber. The hoisting chamber is provided with a counterpart 614 for each of the holding pin, such as a recess, or a slot, so that the holding pins, when protruding from the wall of the lower part into the pin recess, locks the movement of the lower part. The locking pins are arranged to the lower part longitudinally at one side of the sealing system, the part being at inner side i.e. dry side when installed.

When servicing the closing cover while the vessel is floating, the closing cover is attached through its periphery wall 622 to the surrounding opening and the sealing system 604 is activated by inflating the sealing units at the outer cylindrical surface. Now the first part may be removed from the second part by e.g. removing respective screws 624, and any serviceable object revealed by the removing of the first part may be serviced. Thus, the top part 601 may be removed from the lower part 602 after the seal units 606, 608 are activated and the holding pins 610 are inserted in to recesses 614 in the counter surface of the hoisting chamber.

In this way there will be free access to the main seal mating surface under the top part for inspection and/or repair while sealing and locking of the lower part is activated.

The first part is extending radially from inner side of the periphery wall of the second part to outer side of the periphery wall.

Figure 8:
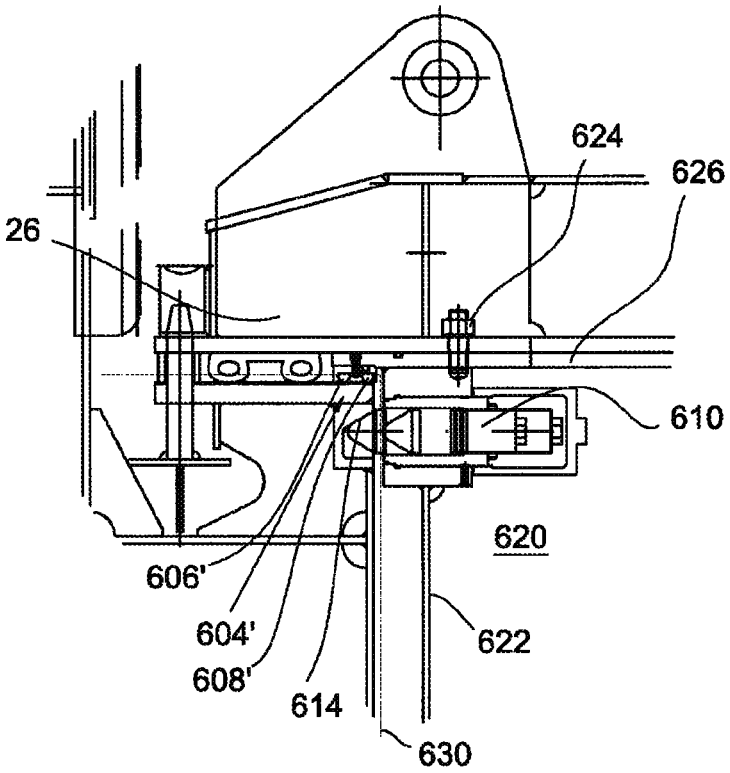
FIG. 8 shows a still further embodiment of the flange.

In FIG. 8 there is shown a closing cover according to another embodiment of the invention. The lower part is also provided with a sealing system 604' at its upper part, on lower surface of a plate 626 on which the upper part 601 is attached. The sealing system comprises two successive O-rings 606', 608' in the radial direction of the hoisting chamber. The sealing system is arranged in a connection path 630 from outside the vessel to inside of the vessel along interconnecting surfaces of the closing cover and the hull of the vessel.

The lower part is also in this embodiment provided with a number of holding means 610. The holding means are pins in this embodiment, which pins may move partially from outer periphery wall surface 622 of the lower part and co-operate with the hoisting chamber. The hoisting chamber is provided with a counterpart 614 for each of the holding pin, such as a recess, or a slot, so that the holding pins, when protruding from the wall of the lower part into the recess, locks the movement of and tightens the sealing system 604' the lower part. The locking pins are arranged to the lower part longitudinally at one side of the sealing system, the part being at inner side i.e. dry side when installed.

When servicing the closing cover while the vessel is floating, the lower part of closing cover is attached through its periphery wall 622 to the surrounding opening tightening the O-rings 606', 608'. Now, the first part may be removed from the second part by e.g. removing respective screws 624, and any serviceable object revealed by the removing of the first part may be serviced. Thus, the top part 601 may be removed from the lower part 602 after the holding pins 610 are securely inserted in to recesses 614 in the counter surface of the hoisting chamber.

In this way there will be free access to the main seal mating surface under the top part for inspection and/or repair while sealing and locking of the lower part is activated.

The first part may be is a flange plate extending radially from inner side of the periphery wall of the second part to over the periphery wall.

When installing the unit again in its mounted position, in case the lifting devices 500 or the jacks have been removed, the jacks are remounted at their positions explained above. Next the chamber is flooded e.g. with a water pump up to a proper level corresponding the ship's draft. Next the bottom closing cover is demounted in a similar manner explained above in connection with the flange 24.

The unit will be lowered into the flooded hoisting channel until it lands and rests on the actuated i.e. extended jacks, which are positioned at the bottom of the channel. Then, the cylinders 111 are controlled to extend their rods 112 and, guided by the guide surface 113, each clamp 114 will move into engagement with the shallow recesses 115 on the flange 24. Now the working pressure on each hydraulic jack can be released in a controlled manner and the jacks will be retracted down with appropriately low actuating pressure on the cylinders 111. This takes place while the hoisting chamber is filled with water. When the clamping means have clamped the unit 2 into the mounted position, water can be pumped out of the hoisting chamber so as to dry the working space there. It is noted that the cylinders of clamping means are also maintained in a locked state, for safety reasons.

Once the water has been pumped off, persons for re-applying the fixing means 14 may climb down the hoisting chamber to set the screws. After the screws have been set and fixed, the clamping means can be retracted by retracting the rod 112 into the cylinder 111. This is recommended, because the cylinder rod 112 is then protected against corrosion when it is located in the cylinder 111.

Figure 5:
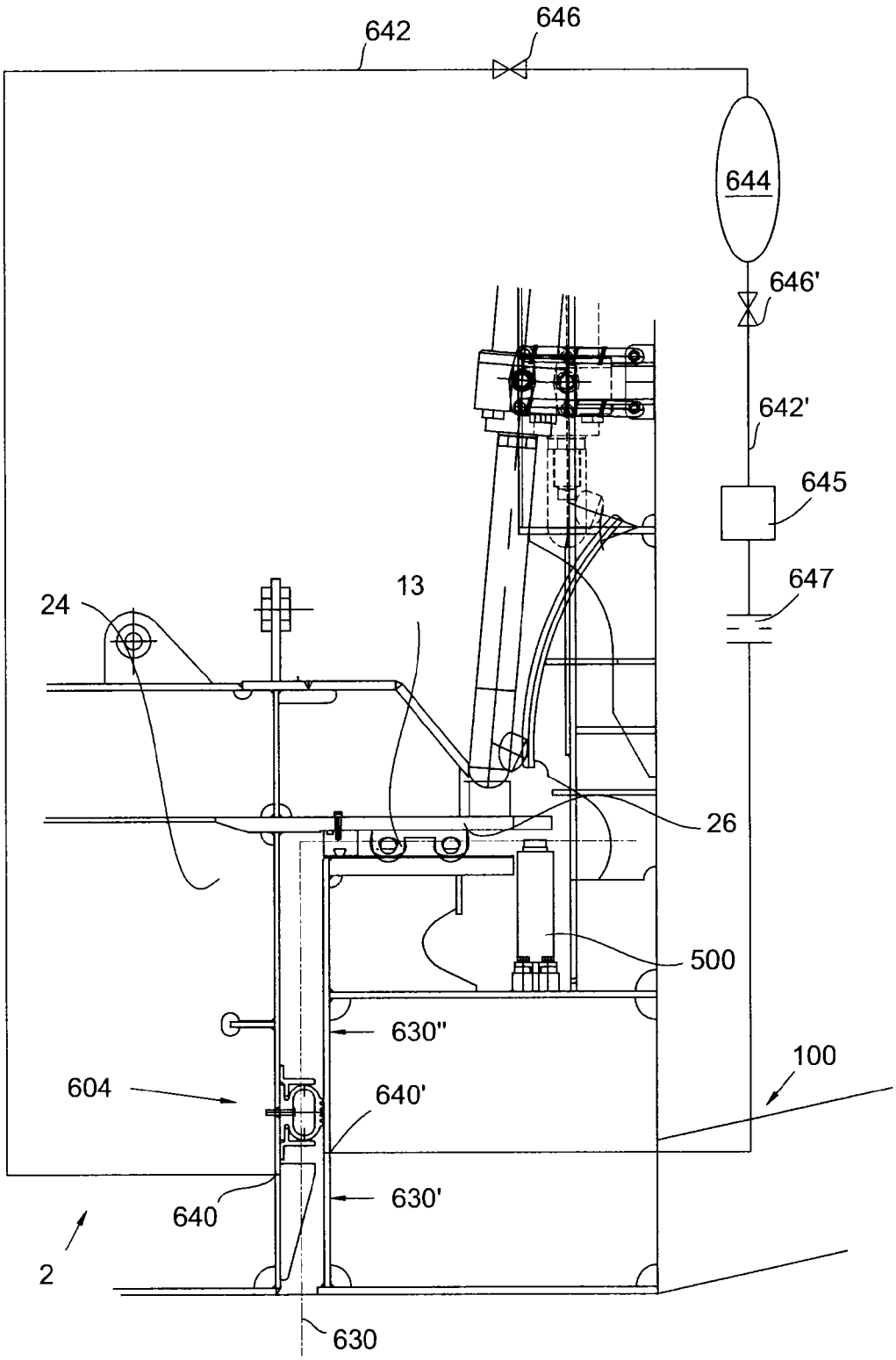
FIG. 5 shows a detail of hoisting chamber and a flange portion connection.

Returning back to FIG. 5, in which a still another embodiment of the invention is described. As is depicted also in FIG. 5 by the dotted line the assembly comprises a connection path 630 which runs through a potential route to the water underneath the vessel from outside the vessel to inside of the vessel along interconnecting surfaces of the unit 2 or the flange thereof and the hull of the vessel 100. There is a sealing system 604 which divides the connection path 630 to outside connection path portion 630' and inside connection path portion 630". The outer side connection path portion 630' opens into the surroundings i.e. water when the vessel is floating. According to an embodiment of the invention the unit 2 is provided with a gas inlet system 640, 640' arranged to open into the outside connection path portion 630'. Naturally only one inlet system is needed and the separated conduits in FIG. 5 are for purpose of example.

The gas inlet system 640, 640' comprises a conduit 642, 642' extending through the unit or though the hull and is connectable to a source of gas 644 arranged in the vessel. The source of gas is advantageously a pressurized air system of the vessel. The source of gas may also comprise an air-nitrogen converter 645, in which case the gas which is fed to the space is advantageously nitrogen. Thus, the gas inlet system is arranged to inject dry nitrogen into the space, so that a pressure above the water hydrostatic pressure at prevailing draft is controllably maintained in the outside connection path portion. This prevents any sea growth in the space and also prevents sea water to enter into the space. Advantageously only service air is needed to feed this system. There is also a control system 646, 646' for maintaining a predetermined supply of gas to the inlet gas system. The control system may comprise e.g. a pressure sensor. The control system may comprise e.g. a valve 646, 646' and or an orifice plate 647.

Figure 4:
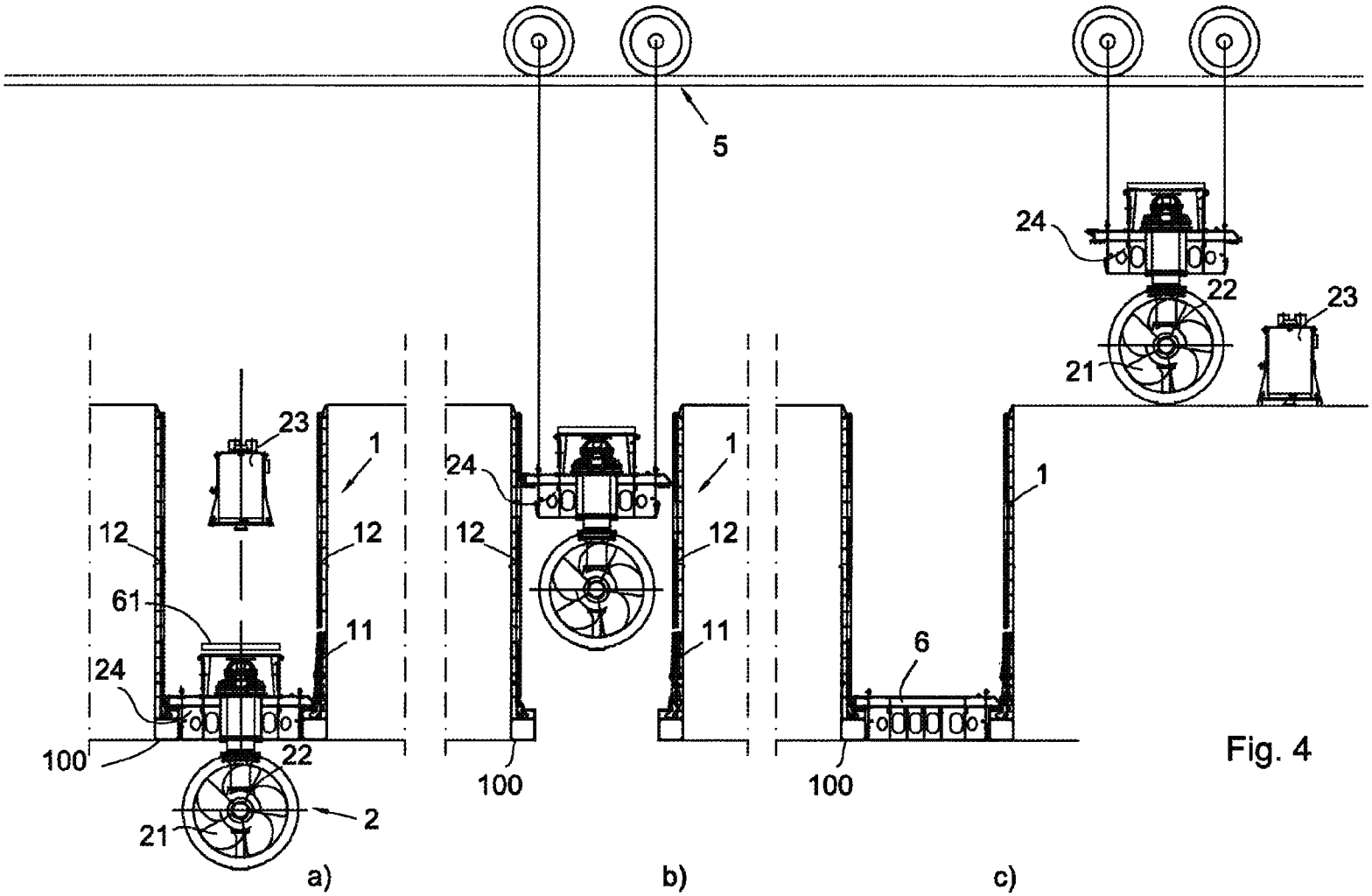
FIG. 4 shows the sequence of dismounting a thruster unit from the vessel hull.

Finally, FIG. 4 shows a sequence of steps a), b), c) in which a unit in the form of a thruster 2 is dismounted from a vessel hull 100. On the left in FIG. 4, a step a) is shown in which the electric drive motor 23 is removed from the thruster 2. After removal of the electric motor 23, cover 61 or covers are mounted to the thruster 2 to close all openings against the immersion of water when the hoisting chamber 1 is to be flooded. The drive connection of the thruster 2 usually consists of a flexible coupling; it may however also or additionally include a gear box. Also, a hoist means 7 is already fixed to the flange 24 of the thruster 2 as is indicated at the right lifting eye in step a) of FIG. 4. Further, the clamping means are activated so as to clamp the flange 24 against its seat in the vessel hull 100. Once the clamping is set, the fixing means (screws) can be removed and the persons leave the hoisting chamber.

Then, the clamping means is gradually released so as to let water flow into the hoisting chamber. Once the hoisting chamber is filled to the required water level, the clamping means can be released and the lifting devices activated, that is, as described under reference to FIG. 3, the rods of the cylinders are retracted. Then, continuing to step b) in the middle of FIG. 4, it is shown that the hoist means 7 of a crane 5 are used to pull up the thruster 2 by lifting it at the lifting eyes. During lifting, the thruster 2 is guided in the hoisting chamber by means of the guide rails which are indicated with several parallel lines on the chamber walls in step b) of FIG. 4. When the thruster 2 is completely withdrawn from the hoisting chamber 1, the status of step c) in FIG. 4 will be established in that a provisional cover 6 is inserted into the hoist chamber so as to close the opening in the vessel hull using the flange seat at the bottom of the chamber. It is noted that clamping with the clamping means is possible because the cover 6 has the same clamping pads as are provided with the flange 24 of the thruster 2. Depending on how long the hoisting chamber has to stay closed, the cover may be additionally fixed with fixing means after the water has been removed from the chamber. Basically, however, it should be sufficient to press the cover down by a clamping means. Also, an additional cover 4 is put on the top of the hoisting chamber for safety reasons as discussed above.

In FIG. 4, dismounting the thruster and putting it on deck of the vessel has been described. Mounting of the thruster after maintenance or for replacement is done in the opposite order of steps. That is: removing cover 4, clamping cover 6, fixing hoist means 7 to cover 6, removing any fixing means (if any), and gradually releasing the clamping force so as to flood the hoisting chamber 1. Once the required water level is reached in hoisting chamber 1, cover is lifted after clamping has been released. The cover 6 is removed from hoisting chamber 6. Then, proceeding back to step b), the thruster 2 fixed to the hoist means 7 will be led down the hoisting chamber 1 while being guided by the guide rails 12. Once the thruster 2 is set in its mounting position, clamping means 111, 112, 114, 115 are activated to press the flange 24 of the thruster 2 against its seat to seal the bottom of the hoisting chamber 1. The hoisting chamber 1 is then pumped empty and in the dry space fixing means like screws are set and fixed. After that, clamping may be released. Hoist means 7 are separated from the lifting eyes of the thruster and covers 61 are removed. Thereafter, the electric motor 23 can be lowered into position and fixed for operation. After connection work has been done, the thruster 2 is ready for use again.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. In the above example, the invention has been described using a thruster as the unit which passes through the vessel hull. However, it may be any, in particular large, unit of any vessel or ship for the maintenance of which the invention may be applied. In particular, these units can be oil or gas well connectors, drilling equipment, pumping equipment, etc. Due to the clamping provided to hold the unit in sealing contact with its sealing seat, and having an automatic engagement of the clamping means provided, it can be achieved that no person has to enter a water-filled hoisting chamber, that is, all steps can be carried out in dry environment without diving work. Of course, modifications can be seen in using divers for setting the clamping means or other work. The details mentioned in connection with any embodiment above may be used in connection with another embodiment when such a combination is technically feasible.

The invention claimed is:

1. An assembly in a marine vessel comprising:

a thruster having a flange, the thruster arranged in a water tight chamber opening in a hull of a vessel, wherein the thruster is adapted to extend into the water below the vessel when at a mounted position, a connection path between an inside and an outside of the vessel, formed between interconnecting surfaces of the flange of the thruster and the hull of the vessel, the connection path having a sealing system;

the sealing system dividing the connection path into an outside connection path portion between the flange of the thruster and the hull of the vessel opening into the surroundings and an inside connection path portion; and a gas inlet system coupled with the outside connection path portion, the gas inlet system comprising a conduit extending through the thruster and/or through the vessel hull, the conduit comprising an end coupled to the outside connection path portion.

2. An assembly according to claim 1 wherein the conduit is in connection with a source of inert gas.

3. An assembly according to claim 2, wherein the source of inert gas comprises an air-nitrogen converter.

4. An assembly according to claim 1 wherein the conduit is in connection with a source of pressurized air.

5. An assembly according to claim 1, wherein the sealing system is located at a periphery surface of the flange of the thruster closing the opening in the vessel hull when the thruster is mounted to the vessel.

6. An assembly according to claim 1, wherein the sealing system is located at a lower surface of a flange plate portion of the flange of the thruster, the flange closing the opening in the vessel hull when the thruster is mounted to the vessel.

7. An assembly according to claim 1 further comprising a control system for maintaining a predetermined supply of gas to the inlet gas system.

8. An assembly according to claim 7 wherein the control system comprises a valve.

9. An assembly according to claim 7 wherein the control system comprises an orifice plate.

10. An assembly in a marine vessel comprising:

a thruster having a flange, the thruster arranged in a water tight chamber opening in a hull of a vessel, wherein the thruster is adapted to extend into the water below the vessel when at a mounted position, a connection path between an inside and an outside of the vessel, formed between interconnecting surfaces of the flange of the thruster and the hull of the vessel, the connection path having a sealing system;

the sealing system dividing the connection path into an outside connection path portion and an inside connection path portion, the outside connection path portion comprising a gas confined section below the sealing system and above a water line of the water in the outside connection path portion; and a gas inlet system in fluid communication with the outside connection path portion to provide gas to the outside connection path portion to maintain a pressure above the water to prevent sea growth in the outside connection path portion.

* * * * *